US007330161B2

(12) United States Patent
Matsugatani et al.

(10) Patent No.: US 7,330,161 B2
(45) Date of Patent: Feb. 12, 2008

(54) ANTENNA, RADIO DEVICE, METHOD OF DESIGNING ANTENNA, AND METHOD OF MEASURING OPERATING FREQUENCY OF ANTENNA

(75) Inventors: Kazuoki Matsugatani, Kariya (JP); Makoto Tanaka, Obu (JP); Dowon Kim, Seoul (KR); Moonil Kim, Seoul (KR)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 11/528,614

(22) Filed: Sep. 28, 2006

(65) Prior Publication Data

US 2007/0075903 A1 Apr. 5, 2007

(30) Foreign Application Priority Data

Oct. 3, 2005 (JP) ..... 2005-290312

(51) Int. Cl.
*H01Q 15/24* (2006.01)
*H01Q 1/38* (2006.01)

(52) U.S. Cl. ..... 343/909; 343/700 MS; 343/911 R; 343/770; 343/753

(58) Field of Classification Search ..... 343/909
See application file for complete search history.

(56) References Cited

U.S. PATENT DOCUMENTS 6,262,495 B1 7/2001 Yablonovitch et al. ..... 307/101
6,300,906 B1 * 10/2001 Rawnick et al. ..... 343/700 MS
6,483,481 B1 * 11/2002 Sievenpiper et al. ..... 343/909
6,512,494 B1 * 1/2003 Diaz et al. ..... 343/909
6,774,867 B2 * 8/2004 Diaz et al. ..... 343/909
6,917,332 B2 * 7/2005 Aikawa et al. ..... 343/700 MS
7,173,565 B2 * 2/2007 Sievenpiper ..... 343/700 MS
7,190,315 B2 * 3/2007 Waltho ..... 343/705

OTHER PUBLICATIONS

Matsugatani et al., Kazuoki, "Radiation Characteristics of Antenna with External High-Impedance-Plane Shield," *The Institute Electronic, Information and Communication and Engineers English Papers IEICE Trans. Electron*, vol. E86-C, No. 8 (Aug. 2003): 1542-1549. (Discussed on p. 2 in the specification).

* cited by examiner

*Primary Examiner*—Trinh Vo Dinh
(74) *Attorney, Agent, or Firm*—Posz Law Group, PLC

(57) ABSTRACT

An antenna comprises a first conductive layer, a second conductive layer and an LC resonance circuit. The first conductive layer has plural elements and is disposed adjacently to each other. The second conductive layer is disposed at a predetermined distance from the first conductive layer via a dielectric substrate. The LC resonance circuit comprises connection for electrically connecting the elements and the second conductive layer. The LC resonance circuit takes a resonance state in which impedance becomes high in the operating frequency of the antenna. Of the plural elements, a power feeding section is provided in each of any two adjacent elements. Power is fed to the power feeding sections during transmission so that signals of the operating frequency are opposite in phase, and signals of the operating frequency inputted to the antenna are outputted in opposite phase from the power feeding sections during reception.

19 Claims, 13 Drawing Sheets

ANTENNA, RADIO DEVICE, METHOD OF DESIGNING ANTENNA, AND METHOD OF MEASURING OPERATING FREQUENCY OF ANTENNA

CROSS REFERENCE TO RELATED APPLICATION

This application is based on and incorporates herein by reference Japanese Patent Application No. 2005-290312 filed on Oct. 3, 2005.

FIELD OF THE INVENTION

The present invention relates to an antenna and radio device using it, and more particularly to a flat antenna formed on a dielectric substrate. The present invention also relates to methods of designing and measuring operating frequency of an antenna.

BACKGROUND OF THE INVENTION

A patch antenna has a typical structure of a flat antenna. The patch antenna uses a rectangular or circular metallic pattern formed on a surface of a dielectric substrate as a radiator, the metallic pattern resonating in radio frequency signals sent or received. The patch antenna uses a metallic film formed on a back surface of the substrate as a ground electrode. Since general patch antennas have a ground electrode on the back surface, they exhibit the directivity that radio waves are directed to a surface (front) direction of the antenna. Because of this characteristic, the patch antennas are often used in applications in which they are stuck to the surface of equipment or a wall to transmit and receive radio waves in the direction toward the front of the antenna. However, when the size of the ground electrode of the patch antennas is small, the directivity of the antennas is insufficient for radiation in the front direction, so that some radio waves leak to sides and the rear, possibly resulting in interference.

For suppressing unnecessary radiation to sides and the rear in a patch antenna, A high impedance plane (HIP), a photonic band gap (PBG), or an electromagnetic band gap (EBG). Since HIP, PBG and EBG basically have similar structures.

As described in U.S. Pat. No. 6,262,495, in the EBG polygonal (e.g., hexagonal) metallic electrodes are cyclically disposed on the surface of a dielectric substrate so that the metallic electrodes are electrically connected with a metallic film formed on the back surface of the dielectric substrate through connection materials within via holes penetrating through the dielectric substrate. In the EBG, since the above structure exhibits the characteristics of a circuit in which inductors (L) and capacitors (C) are continuously connected, an LC resonance occurs in a specific frequency and impedance becomes high when a radio frequency signal transfers through the surface. The frequency area in which impedance becomes high is-called a band gap.

When this phenomenon is combined with a patch antenna 30 as shown in FIGS. 18A and 18B so that EBGs are disposed in the vicinity of the patch antenna 30 to bring the resonance frequency of the patch antenna 30 into agreement with that of EBGs 31, a radio frequency signal radiated from sides of the patch antenna 30 can be attenuated by the resonance effect of the EBGs 31. As a result, the invasion of radio waves into sides and the rear of the patch antenna 30 is suppressed and unnecessary radiation can be suppressed.

In FIG. 18B, the reference numeral 32 designates a coaxial cable. Detailed characteristic results of the above construction are reported in Matsugatani, et al., "Radiation Characteristics of Antenna with External High-Impedance-Plane Shield," the Institute Electronic, Information and Communication and Engineers English Papers IEICE Trans. Electron, Vol E86-C, No. 8, Aug. 2003, p. 1542-1549.

Thus, by combining the EBG and the patch antenna, an antenna can be provided with a thin shape and excellent directivity. However, in the case of the above construction, a frequency bandwidth usable as the antenna becomes narrow. This is attributed to the principle of the patch antenna itself. The patch antenna uses a resonance phenomenon of metallic electrodes formed on a dielectric substrate, and very sharp resonance occurs due to a confining phenomenon of an electric field oriented from ends of the metallic electrodes to the dielectric. As a result, despite the excellent radiation characteristics, the width of resonance frequencies, that is, a frequency width usable for transmission and reception as an antenna becomes very narrow.

Moreover, in the case of combining a patch antenna and EBG, the patch antenna is based on a resonance phenomenon due to a geometrical shape of metallic electrodes, but EBG is based on an LC resonance phenomenon. Therefore, a complicated design is required to bring their resonance frequencies into agreement with each other.

SUMMARY OF THE INVENTION

The present invention therefore has an object to provide an antenna that has a wide frequency band and is easy to design, radio device, a method of designing the antenna, and a method of measuring the operating frequency of the antenna.

According to one aspect of the present invention, an antenna is constructed with a first conductive layer, a second conductive layer and an LC resonance circuit. The first conductive layer has plural elements disposed adjacently to and distanced from each other on a same plane. The second conductive layer is disposed at a predetermined distance from the first conductive layer via a dielectric. The LC resonance circuit includes connection for respectively electrically connecting the elements of the first conductive layer and the second conductive layer. The LC resonance circuit is constructed to take a resonance state in which impedance is increased in an operating frequency of the antenna. The power feeding section is provided in each of any two adjacent elements of the plural elements. During transmission, power is fed to the power feeding sections so that signals of the operating frequency are in an opposite phase relation to each other. During reception, signals of the operating frequency inputted to the two elements are outputted in an opposite phase relation to each other from the power feeding sections.

According to another aspect of the present invention, the above antenna is used in a radio device together with a power dividing/combining circuit and a processing circuit that performs at least one of transmission processing and reception processing for radio frequency signals. The power dividing/combining circuit operates with two divided output signals or two combining input signals opposite in phase to each other. The above antenna is also used in a radio device together with a circuit part that performs at least one of transmission processing and reception processing for radio frequency signals. The circuit part is housed in IC or a small-sized package, and is connected to the power feeding section via a terminal for external connection.

According to a further aspect of the present invention, the above antenna is designed by computing a reflection phase of a signal on an antenna surface under a condition that the power feeding sections of the antenna are in an open state, determining an operating frequency of the antenna when the calculated reflection phase is in a range from −90 degrees to +90 degrees, and changing antenna specifications until the determined operating frequency becomes an intended frequency. Actual operating frequency of the antenna is measured by driving the power feeding sections of the antenna into an open state, measuring a reflection phase of a signal on an antenna surface, and determining an operating frequency of the antenna when the measured reflection phase is in a range from −90 degrees to +90 degrees.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENTS

First Embodiment

Figure 1A:
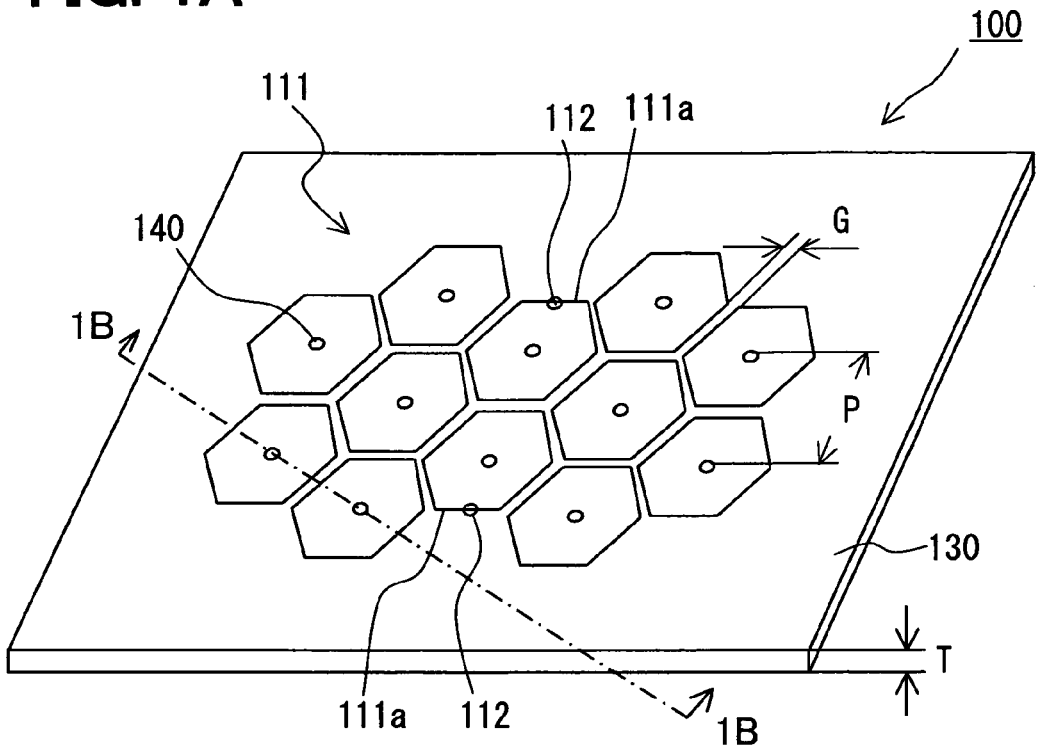
FIG. 1A is a perspective view of an antenna according to a first embodiment of the present invention.
Figure 1B:
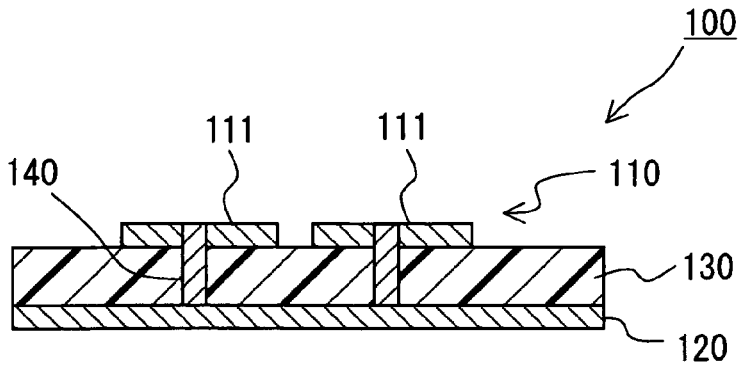
FIG. 1B is a sectional view of the antenna taken along a line 1B-1B in FIG. 1A.

As shown in FIGS. 1A and 1B, an antenna 100 comprises plural elements 111 constituting a first conductive layer 110, a second conductive layer 120 disposed at a predetermined thickness T from the first conductive layer, a dielectric substrate 130 provided between the first conductive layer 110 and the second conductive layer 120, and conductive connecting members 140 for respectively electrically connecting the elements 111 and the second conductive layer 120.

The first conductive layer 110 has plural elements 111 made of conductive materials. The elements 111 are disposed adjacently to and separated from each other on a same plane of the dielectric substrate 130. The shape and size of the plural elements 111 are not limited as long as capacitors can be formed between adjacent elements 111. However, if all of the elements are substantially identical in shape and size, it becomes easy to design them. Efficient disposition of the elements 111 contributes to miniaturization.

In this embodiment, the elements 111 are of polygonal shape in plane direction and the distance (gap G) between opposing sides of adjacent elements 111 are all substantially equal. In this embodiment, a regular hexagon is used as polygonal shape. Accordingly, the elements 111 can be efficiently disposed. Since a field distribution is more even than that with other polygonal shapes uniform, a transmission (reception) area can be made wider in a same disposition.

More specifically, twelve regular hexagon elements 111 are disposed adjacently to each other on one surface of the dielectric 130 so that all gaps between opposing sides are constant. Such elements 111 can be formed by patterning and screen printing of a metallic foil (e.g., copper foil) provided on the dielectric substrate 130. The relationship of the number of the elements 111 and reflection coefficients will be described later.

The second conductive layer 120 is made of a conductive material, and is disposed at a predetermined thickness T from the first conductive layer 110 formed by the elements 111. The second conductive layer 120 is formed with a predetermined size (plane direction) on a back surface of the surface of the dielectric substrate 130 having a thickness of t on which the elements 111 are formed, and functions as GND. The second conductive layer 120 can be formed by applying the metallic foil provided on the dielectric substrate 130, or applying screen printing, a CVD method, and the like.

A material of the dielectric substrate 130, and its thickness T are not limited to specific ones. They may be properly set according to the design specifications of the antenna 100. In this embodiment, a substrate made of PPO (polyphenylene oxide) resin is adopted. One of the metallic foils placed on both sides of the dielectric substrate 130 is patterned to form the elements 111, and the other is used as the second conductive layer 120. To electrically connect the elements and the second conductive layer 120, via holes penetrating from each element 111 through the second conductive layer 120 are formed on the dielectric substrate 130, and the connecting members 140 are placed in the via holes (e.g., by plating or paste filling). In this embodiment, the via holes are formed on the dielectric substrate 130 and the connecting members 140 are disposed so that the distances between the locations in which the connecting members 140 and the elements 111 are connected with each other are respectively equal to a predetermined value (pitch P). More specifically, the connecting members 140 are connected to the center of the elements 111 having a regular hexagon.

An LC resonance circuit, that is, EBG, is formed by the elements 111, the second conductive layer 120, and the connecting members 140 formed on the dielectric substrate 130. Specifically, a capacitor (capacitance C) is formed between the elements adjacent to each other with a gap G, and an inductor (inductance L) is formed by a current path loop from the element 111 to the element 111 through the connecting member 140, the second conductive layer 120 and the connecting member 140. The LC resonance circuit (EBG) is constructed to take a resonance state in which impedance becomes high in an operating frequency of the antenna. Specifically, the constituting material (relative permittivity) and thickness T of the dielectric substrate 130, the gap G between the elements 111, and the pitch P between the locations in which the connecting members 140 and the elements 111 are connected with each other are set to predetermined values.

Of the plural elements 111, each of two adjacent elements 111*a* arbitrarily selected is provided with a power feeding section 112. During transmission, signals of an operating frequency having phases opposite to each other are fed to the power feeding sections 112. During reception, signals of an operating frequency inputted to the two elements 111*a* are outputted to take phases opposite to each other from the power feeding sections 112.

The two elements 111*a* are arbitrarily selected as the center of the twelve elements 111 adjacently disposed. Specifically, five elements 111 are symmetrically disposed at each of the right and left sides of the elements 111*a*. In such a construction in which other elements 111 are symmetrically disposed at the right and left sides of the elements 111*a* in at least one axis direction constituting a plane, field distribution can be made even in the axis direction. The relationship between the disposition of the power feeding sections 112 in the elements 111 and reflection coefficients will be described later.

In the antenna 100, the LC resonance circuit (that is, EBG) is constructed to operate as an antenna as well. In a conventional structure with a flat antenna (patch antenna) and EBG combined, it has been necessary to bring the frequencies of a patch portion and an EBG portion into agreement. However, since the antenna 100 according to this embodiment can be designed simply by bringing the resonant frequency of the elements 111 into agreement with an intended frequency, (EBG and a plate antenna do not need to be designed individually), the design of the antenna is easier than that of conventional ones.

Since the resonance of the antenna 100 is based on LC resonance phenomena, a flat antenna having a wider frequency band can be provided in comparison with conventional flat antennas, particularly patch antennas. Furthermore, since the antenna 100 is based on an EBG structure, because of the intrinsic effect of the EBG of having high surface impedance, unnecessary radiation from the sides and rear of the antenna 100 can be suppressed. The antenna 10 has the so-called dipole structure.

The antenna 100 according to this embodiment has a thin construction like the conventional constructions with a patch antenna and EBG combined, and can exhibit excellent directivity, depending on the disposition of the elements 111.

The above antenna 100 may be designed in the following manner.

Figure 2:
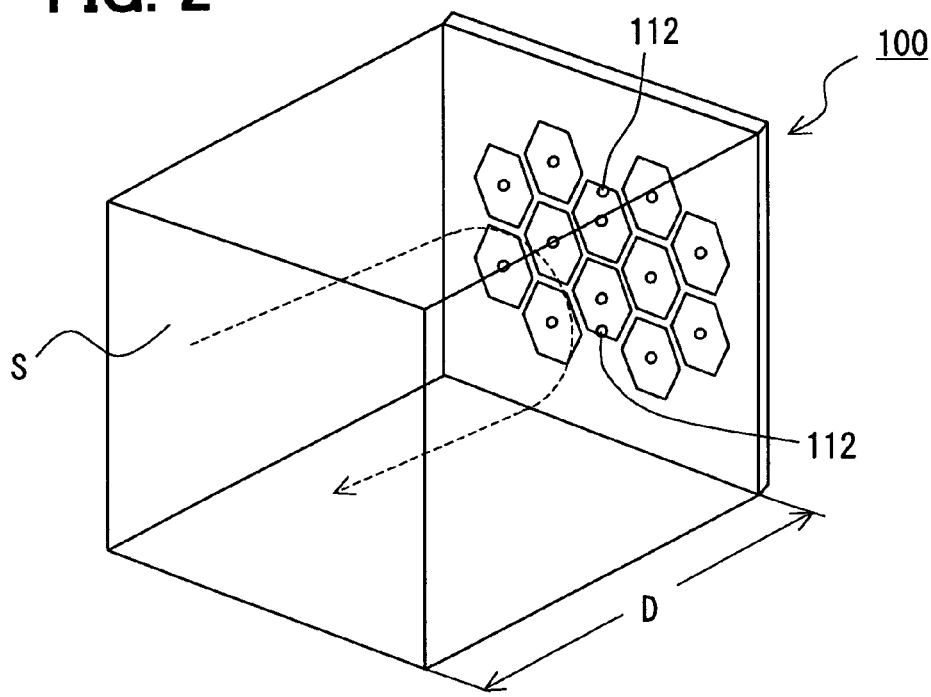
FIG. 2 is a schematic diagram showing a model structure used to compute the operating frequency of an antenna.

First, as shown in FIG. 2, a model structure is used to compute the operating frequency of the antenna 100. A virtual cubic space is formed on a computer simulator as shown in FIG. 2, and a radio frequency signal is inputted from a reference side S. The antenna 100 is placed on a wall at a distance D from the reference side S. The power feeding sections 112 are not connected to anything, and put in an open state. The frequency of the radio frequency signal is changed, and a phase change amount of the signal inputted from the reference side S after reflection in the surface of the antenna 100 until return to the reference side S is obtained by computer simulation. After this, by eliminating phase delay corresponding to the distance D from the reference side S to the surface of the antenna 100, a reflection phase on the surface of the antenna 100 is computed. As a computer simulator, an electromagnetic simulator by use of the finite element method can be applied.

Figure 3:
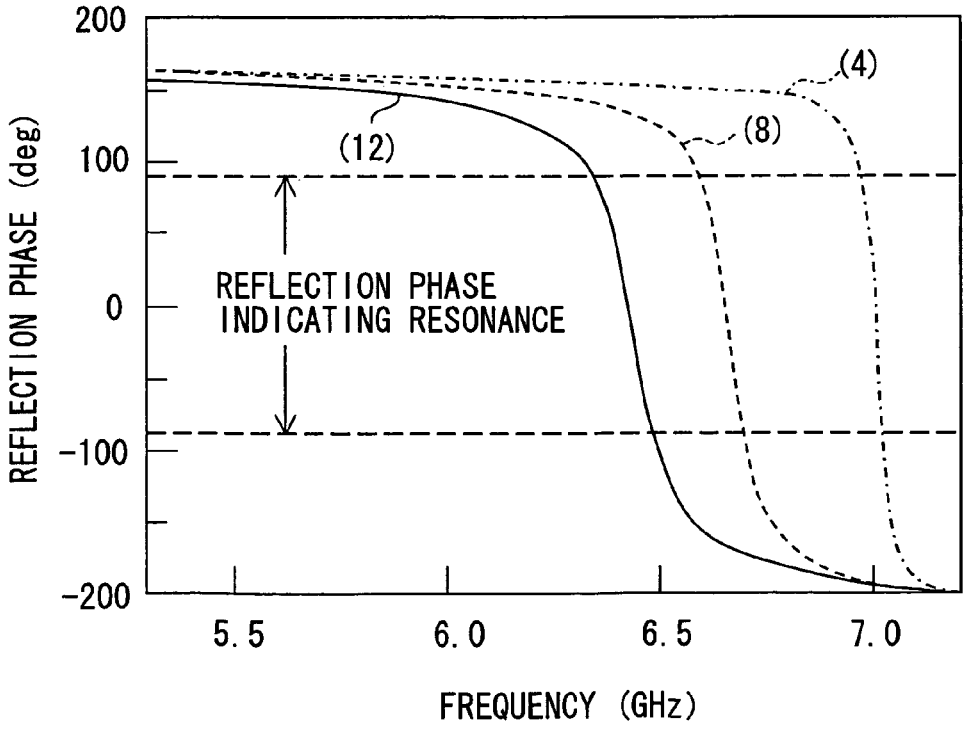
FIG. 3 is a graph showing the results of computing reflection phases.
Figure 5A:
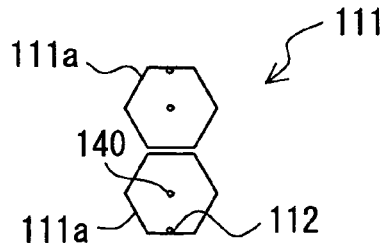
FIGS. 5A, 5B, 5C and 5D are plan views showing elements used for a study of the relationship between the number of elements and reflection coefficients.
Figure 5B:
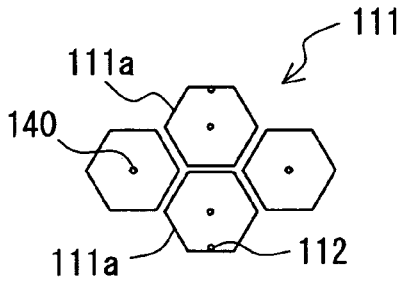
Figure 5C:
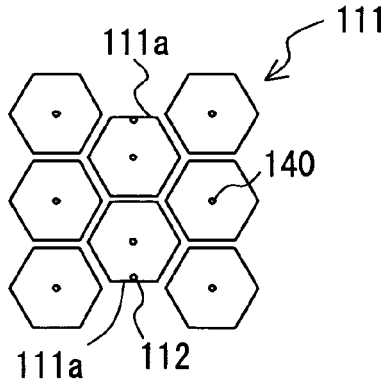
Figure 5D:
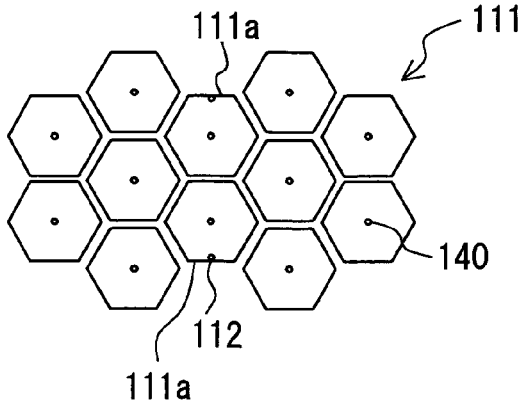

FIG. 3 shows an example of actual computation. The computation was made using 9.8 as the relative permittivity of the dielectric substrate 130, 1.27 mm as the thickness T, and 0.3 mm as the gap G and 5.5 mm as the pitch P of the elements 111. FIG. 3 shows the cases of four elements (alternate long and short dash line) arranged as shown in FIG. 5B, eight elements (broken line) arranged as shown in FIG. 5C, and twelve elements (solid line) arranged as shown in FIG. 5D, respectively, including the elements 111*a* to which the power feeding sections 112 are connected as shown in FIG. 5A.

As the frequency of a radio frequency signal increases, a reflection phase in the surface of the antenna 100 changes from +180 degrees to −180 degrees. In a structure (EBG structure) with the elements 111 disposed, an LC resonance occurs. When an impedance rises, the absolute value of a reflection phase becomes small and takes a range from −90 degrees to +90 degrees. This is disclosed in U.S. Pat. Ser. No. 6,262,495. Accordingly, a frequency exhibiting a reflection phase in the range (from −90 degrees to +90 degrees) may be used as the operating frequency of the antenna 100.

As above, the relative permittivity and thickness T of the dielectric substrate 130, the gap G and pitch P of the elements 111, and the number of elements 111 are temporarily set, and the computation model shown in FIG. 2 is created on the computer simulator. Next, a frequency range in which computed reflection phase characteristics are in the range from −90 degrees to +90 degrees as shown in FIG. 3 is determined to obtain an operating frequency range based on the temporarily set parameters. When the operating frequency range includes an intended operating frequency, the design work is finished, and the antenna 100 is manufactured using the temporarily set parameters. When the intended operating frequency is outside the operating frequency range, at least one (e.g., pitch P or gap G) of the above parameters is changed to repeat the computation, and obtain parameters for obtaining the intended operating frequency. By thus utilizing the computer simulation, design parameters in the antenna 100 can be determined.

The operating frequency of the antenna 100 manufactured as above may be measured in the following manner. Conventionally, as a common method of measuring the operating frequency of an antenna, with equipment such as a network analyzer connected to a power feeding section of the antenna, a reflection coefficient of the antenna power feeding section is measured by changing a frequency. In the operating frequency of the antenna, a radio wave inputted to the power feeding section is radiated from the antenna to the air, a reflection coefficient becomes small indicating that the antenna is operating efficiently. Therefore, an operating frequency can be determined in a point in which a reflection coefficient becomes small by measuring the frequency dependency of reflection coefficients. However, with this method, the measurement is impossible when a coaxial cable or the like is not connected directly to the antenna. For example, since equipment with an antenna and a radio module integrated is designed on the assumption that the antenna and the radio module are directly connected, it is difficult to use this measurement method because a coaxial cable cannot be connected to the antenna for measurement.

Figure 4:
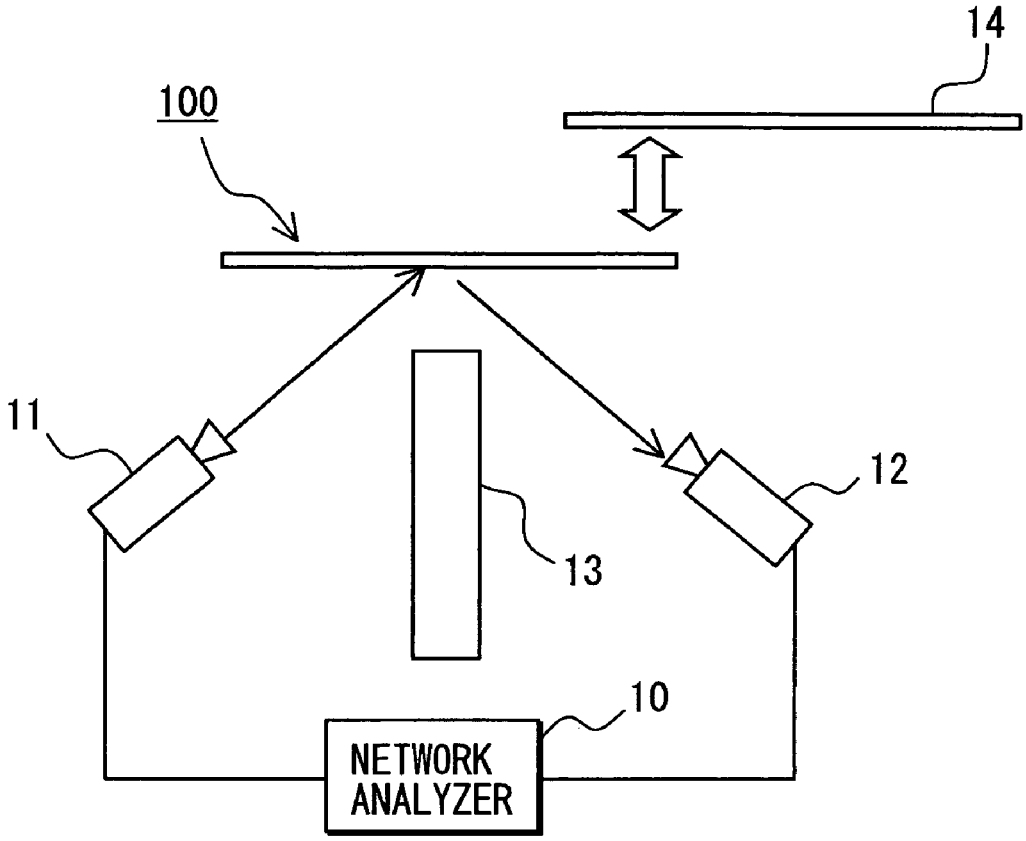
FIG. 4 is a schematic diagram showing a system that measures the operating frequency of an antenna.

Therefore, a measurement is performed by a measurement system shown in FIG. 4. A transmission port 11 and a reception port 12 are connected using a network analyzer 10 having two ports. Devices are disposed so that a radio wave is radiated from the transmission port 11, the signal is inputted to the antenna 100, and a signal reflected on its surface can be detected in the reception port 12. A wave absorber 13 is disposed between the transmission port 11 and the reception port 12 to prevent a radio wave discharged from the transmission port 11 from directly entering the reception port 12 without reflecting in the antenna 100.

It is known that a radio wave reflects on the surface of a metallic plate at a phase of 180 degrees regardless of frequencies because of the effect of image currents. Accordingly, using the above measurement system, the frequency dependence of a reflection phase of the antenna 100 is measured. An actual measurement was made in a state in which the power feeding section 112 of the antenna 100 was not connected to anything and put in an open state. Next, for comparison, a metallic plate 14 having the same size as the antenna 100 was disposed in a position in which the antenna 100 was measured, and the frequency dependence of a reflection phase was measured. The phase of the antenna 100 was corrected using measured data in the metallic plate 14.

By doing so, a reflection phase on the surface of the antenna 100 can be measured, and the same data as the data shown in FIG. 3 can be actually measured. From the measured data, like the data computed by the computer simulation, by determining a frequency range in which reflection phase characteristics are in the range from −90 degrees to +90 degrees, the operating frequency of the antenna can be obtained. According to this measurement method, without having to connect a coaxial cable or the like to the manufactured antenna 100, with the power feeding section 112 opened, an operating frequency can be measured. Accordingly, performance evaluation at the time of the manufacturing of an antenna is easy.

The relationship between the number of elements 111 and reflection coefficients was studied with respect to various arrangement of the elements 111 shown FIGS. 5A, 5B, 5C and 5D. In each of the arrangements, the computation was made using 9.8 as the relative permittivity of the dielectric substrate 130, 1.27 mm as the thickness T, and 5.5 mm as the pitch P and 0.3 mm as the gap G of the elements 111. A feeding method which applies radio frequency signals having phases opposite to each other to the two power feeding sections 112 was used. In FIGS. 5B to 5D, a symmetric disposition is made in which two elements 111*a* are sandwiched between other elements 111.

Figure 6:
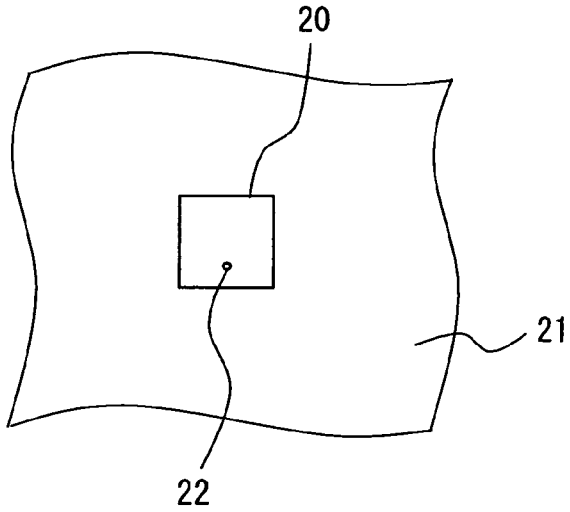
FIG. 6 is a plan view showing a patch antenna, which is a comparison example.

For comparison with the antenna 100 shown in FIGS. 5A to 5D, a patch antenna 20 shown in FIG. 6 was applied. Specifically, on one surface of a substrate 21 having a relative permittivity of 9.8 and a thickness of 1.27 mm like the dielectric substrate 130, a patch antenna 20 is placed on a square area having a side length of 7.4 mm. A power feeding section 22 is provided in a central portion at a distance of 2.8 mm or less from a bottom side of the patch antenna 20. A metallic electrode (not shown) is provided on the entire back surface of the substrate 21 so that a radio frequency signal is fed between the feeding point 22 and the metallic electrode.

Figure 7:
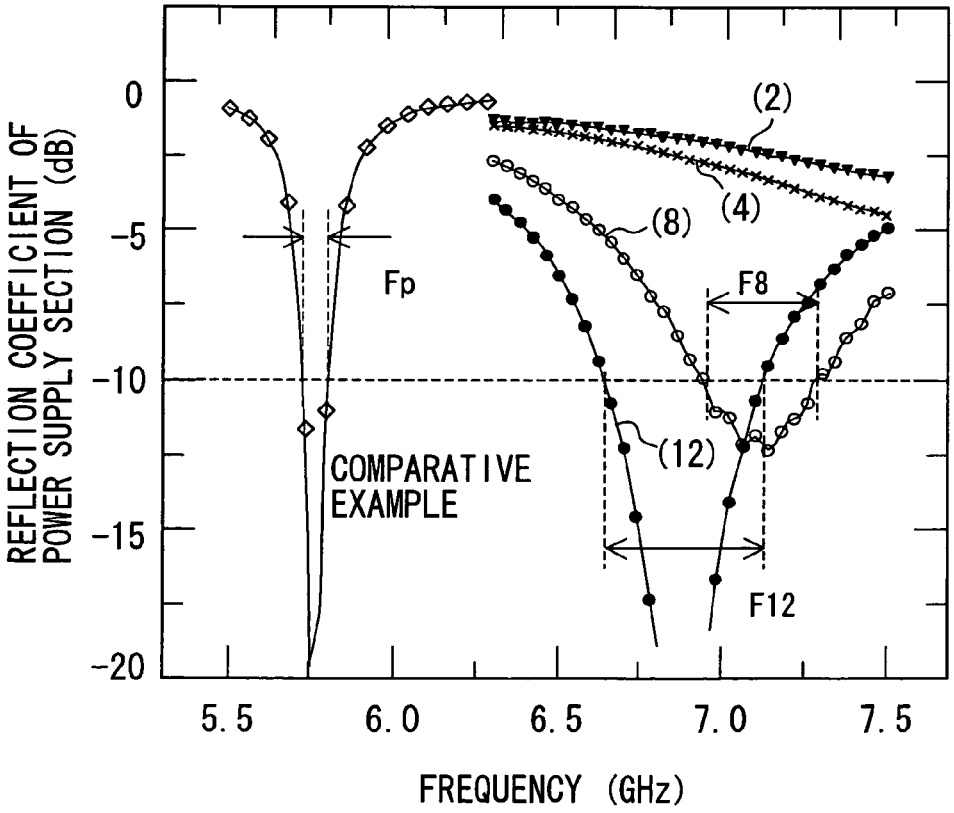
FIG. 7 is a graph showing the frequency dependence of reflection coefficients of power feeding sections.

In this study, to compare operation frequencies with those of prior arts (comparison example) including the patch antenna 20, the frequency dependence of reflection coefficients of the power feeding sections 112 and 22 was computed using computer simulation. Computation results are shown in FIG. 7. As described above, in a state in which the antenna is operating, a radio frequency signal inputted from the power feeding section is radiated to the air as radio waves. Therefore, a reflection coefficient in the power feeding sections becomes small. Generally, practical antennas have a reflection coefficient of −10 dB or less. When the results of FIG. 7 are evaluated from this viewpoint, a practical frequency range of the patch antenna 20, which is a comparison example, is a range indicated by Fp in FIG. 7, approximately 70 MHz in a frequency width, and a very narrow value of 1.7% in a specific bandwidth, which is obtained by dividing a bandwidth by a central frequency.

On the other hand, in the antenna 100 according to this embodiment, as the total number of the elements increases, a reflection coefficient in the power feeding section 112 become smaller. For example, when the total number of the elements 111 is 8, it was found that a practical reflection coefficient is obtained in a range indicated by F8 in FIG. 7. The range of F8 at this time was about 325 MHz in frequency width and about 4.5% in specific bandwidth, which are much wider than those of the patch antenna 20. When the total number of the elements 111 was further increased to 12, a frequency range showing a practical reflection coefficient expanded to F12 in FIG. 7, and was about 500 MHz in frequency width and about 7.3% in specific bandwidth.

According to the antenna 100 of this embodiment, it is apparent that the antenna 100 can be used in a wider range than the comparative example. There may be at least two elements including the power feeding section 112. Though dependent on parameters constituting the antenna 100, if the total number of the elements 111 is eight or more, the reflection coefficient of the power feeding section 112 can be set below −10 dB, which is a guideline of the practical antenna 100. Thus, the antenna 100 can be efficiently operated.

Figure 8A:
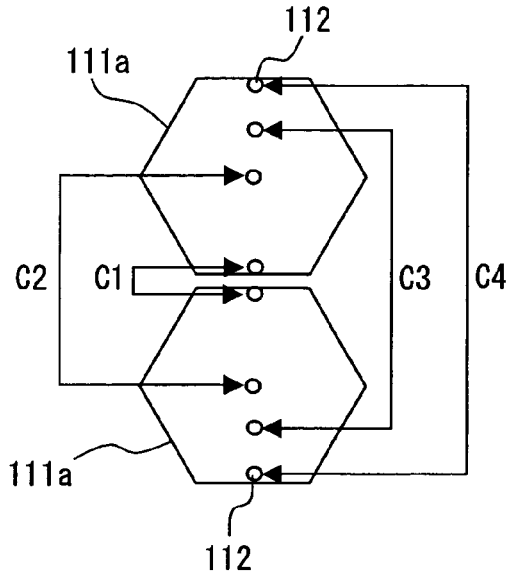
FIG. 8A is a plan view showing the positions of power feeding sections in elements.
Figure 8B:
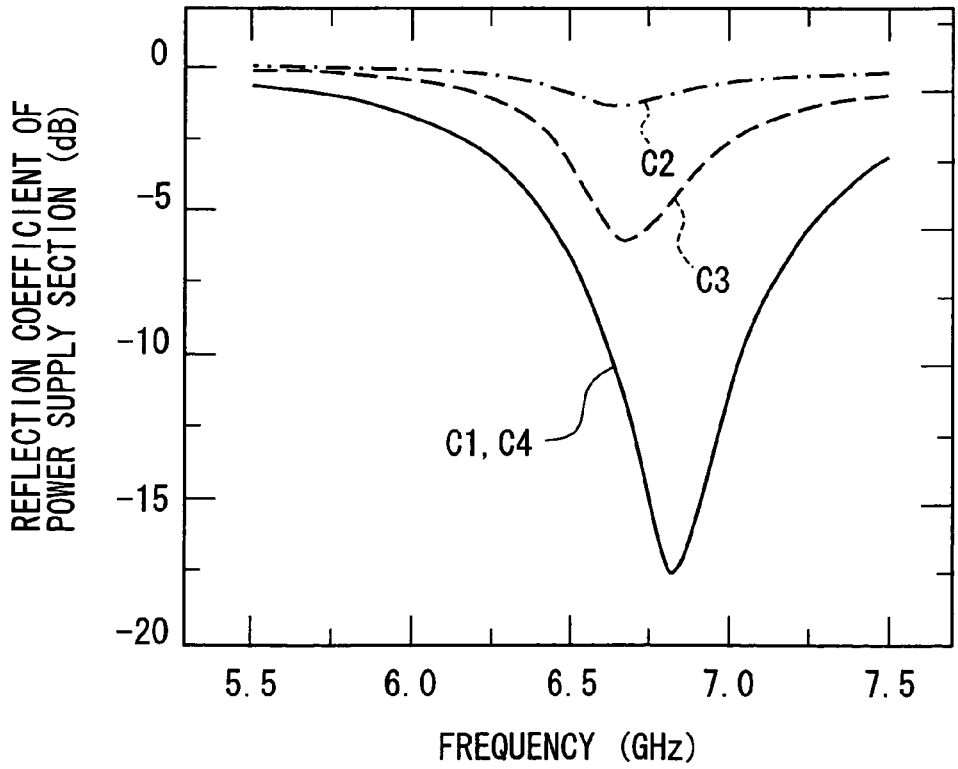
FIG. 8B is a graph showing the results of computing reflection coefficients in the positions shown in FIG. 8A.

The relationship between the disposition of the power feeding sections 112 in the elements 111*a* and reflection coefficients is shown in FIGS. 8B under an arrangement of the power feeding sections 112 in the elements 111*a* shown in FIG. 8A. The elements 111 constituting the antenna 100 have the construction shown in FIG. 5D. However, FIG. 8A shows only the elements 111*a* having the power feeding sections 112. In the elements 111*a*, their respective power feeding sections 112 are provided in positions indicated by C1 to C4 (conditions C1 to C4).

For these conditions C1 to C4, like FIG. 7, the reflection coefficients of the power feeding sections 112 were computed using different frequencies. Like the above computations, this computation was made using 9.8 as the relative permittivity of the dielectric substrate 130, 1.27 mm as the thickness T, and 0.3 mm as the gap G and 5.5 mm as the pitch P of the elements 111.

As shown in FIG. 8B, in condition C2 that places the power feeding sections 112 in the central locations of the elements 111*a*, the reflection coefficient of the power feeding sections 112 is high, indicating that the antenna 100 operates inefficiently. In the position of condition C3, a slight improvement was found. In condition C1, that is, in central locations of two adjacent cells of opposing sides of the elements 111*a*, or in condition C4, that is, in central locations of the opposite sides of the opposing sides of condition C1, if the power feeding sections 112 were disposed, it was found that reflection coefficients became small and the antenna 100 operated efficiently.

In the antenna 100 according to this embodiment, the positions of the power feeding sections 112 provided in two elements 111*a* are not limited. However, if the power feeding sections 112 are respectively provided in two polygonal elements 111*a* at central locations of sides opposite to each other or opposing vertex locations, or at locations in which a line passing through central points of two elements 111*a* intersects with edges of the elements 111*a* and which are in a positional relationship opposite to each other across the gap G between the two elements 111*a*, reflection coefficients of the power feeding sections 112 can be made small. Thus, the antenna can be efficiently operated.

Figure 9A:
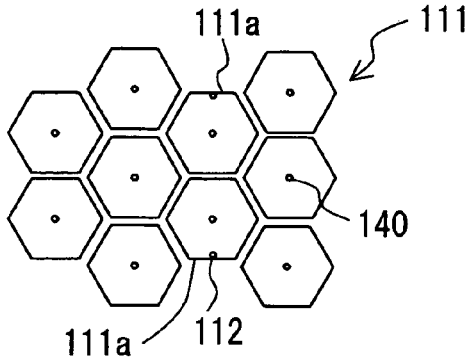
FIGS. 9A and 9B are plan views showing modifications of the antenna according to the first embodiment.

In this embodiment, an example that disposes elements 111*a* having the power feeding sections 112 in a central position of plural elements 111 and symmetrically disposes remaining elements 111 at both sides of the elements 111*a* has been shown. However, for example, as shown in FIG. 9A, in at least one axis direction constituting a plane, other elements 111 may be asymmetrically disposed at both sides of two elements 111*a* having the power feeding sections 112. In this case, since a field distribution leans to a side having fewer elements 111, an intended directivity can be provided in at least one axis direction.

Figure 9B:
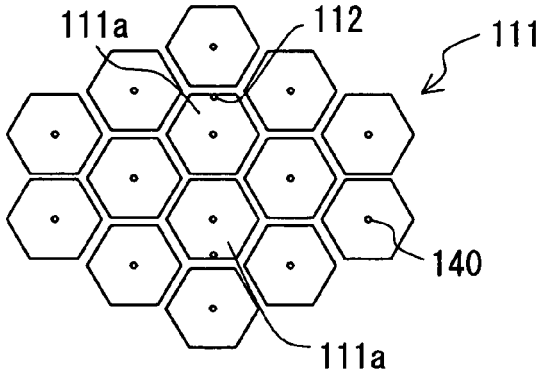

In this embodiment, as exemplified in FIG. 9A, remaining elements 111 are disposed only at both left and right sides of the elements 111*a* having the power feeding sections 112, and the elements 111 are not disposed at upper and lower sides of the elements. However, as shown in FIG. 9B, other elements 111 may be disposed so as to surround a periphery of the two elements 111*a*. In this case, a field distribution can be made more even.

Second Embodiment

In this embodiment, the shape of the elements 111 in a plane direction is a square. In the case of a square, like the case of a regular hexagon, the elements 111 can be efficiently disposed. Moreover, manufacturing costs can be reduced because of easier manufacturing than the cases of other polygonal shapes.

Figure 10A:
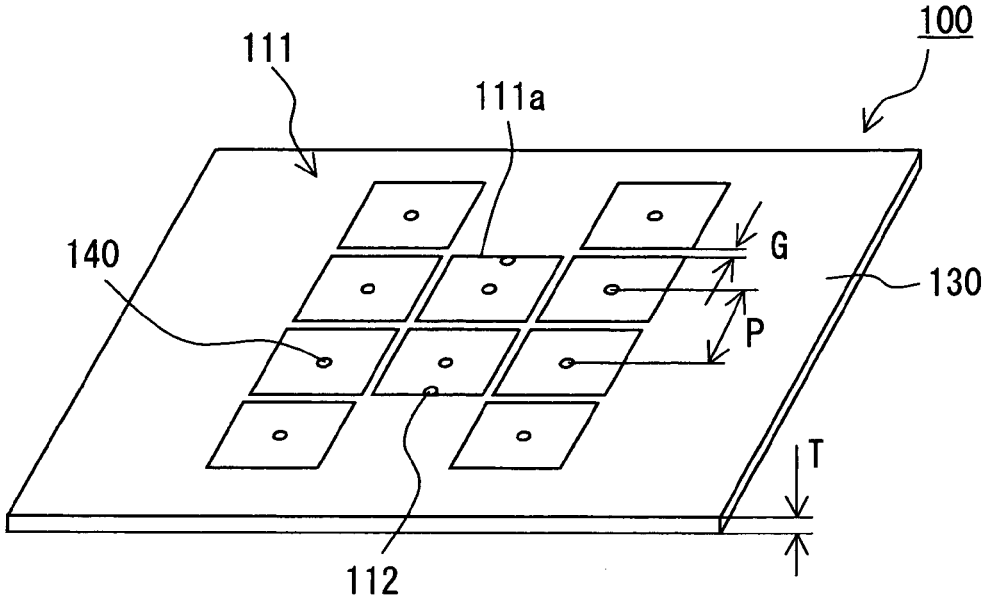
FIGS. 10A and 10B are perspective views showing an antenna according to a second embodiment of the present invention.
Figure 10B:
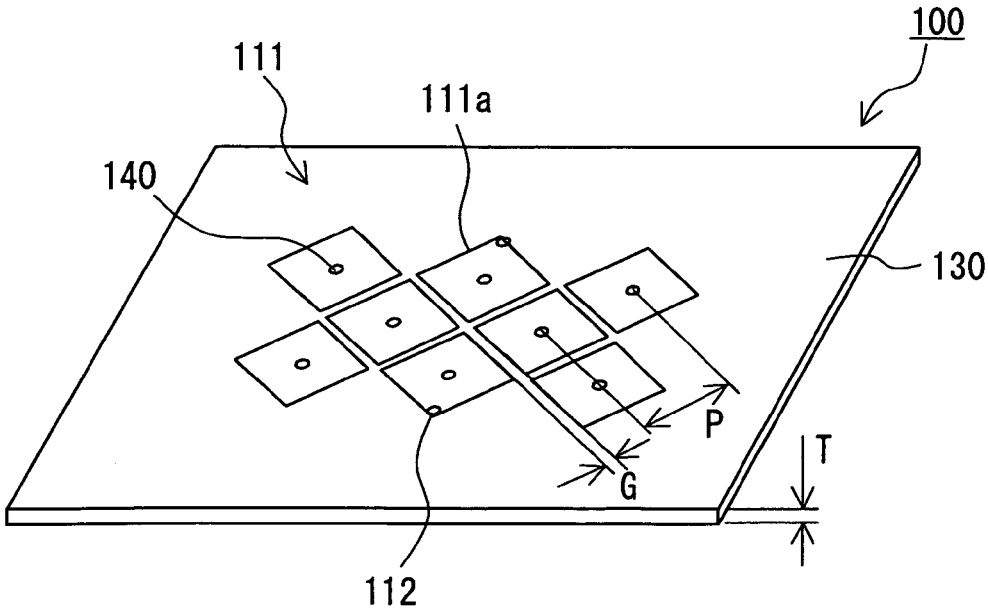

As shown in FIG. 10A, in a construction in which the elements 111 are disposed so that the sides of the elements 111*a* each having the power feeding section 112 are opposed to each other, when the power feeding sections 112 are provided in the center of opposing sides, or in the center of opposite sides of opposing sides, the reflection coefficients of the power feeding sections 112 can be reduced. That is, preferably, the antenna 100 can be efficiently operated. As shown in FIG. 10B, in a construction in which the elements 111 are disposed so that vertexes of the elements 111*a* each having the power feeding section 112 are opposed to each other, when the power feeding sections 112 are provided in opposing vertexes, or in opposite vertexes of the vertexes, reflection coefficients of the power feeding sections 112 can be reduced. Thus, the antenna 100 can be efficiently operated.

Other constructions, operations, and characteristics are similar to those of the antenna 100 shown in the first embodiment. Therefore, a method of computing an operating frequency, a method of measuring an operating frequency, the relationship between the number of the elements 111 and reflection coefficients, and the relationship between the positions of the power feeding sections 112 and reflection coefficients may be devised in the same way as the structures studied in the first embodiment.

Third Embodiment

In this embodiment, to connect to the outside, a microstrip line 150 is provided on a surface of the dielectric substrate 130 on which elements are formed, so that power is fed to the antenna 100 via the microstrip line 150. Specifically, in the antenna 100 in the first or second embodiment, the power feeding sections 112 are provided in the centers of opposite sides of opposing sides (or opposing vertexes) of two elements 111*a*, and the elements are disposed so that the sides or vertexes in which the power feeding sections 112 do not approach other elements 111. The microstrip lines 150 are respectively connected to the locations of the power feeding sections 112 and connected to the outside of the antenna 100 (dielectric substrate 130). Power is fed to the microstrip lines 150 so that phases of radio frequency signals are opposite to each other. That is, if the phase of one radio frequency signal is 0 degree, the phase of the other is 180 degrees. Such microstrip line 150 can be formed by patterning or screen printing of the metallic foil (e.g., copper foil) provided on the dielectric substrate 130. In this embodiment, by patterning the metallic foil on the surface of the dielectric substrate 130, the microstrip line 150 is formed at the same as the elements 111.

The microstrip line 150 may be used by connecting a radio frequency circuit that uses an existing microstrip. Using a known connection method, a coaxial connector may be connected to the microstrip line 150 to enable the connection of a coaxial cable.

Fourth Embodiment

Figure 12A:
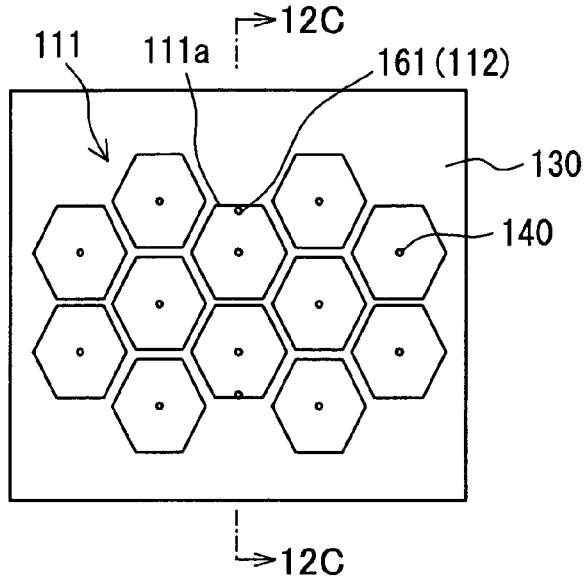
FIG. 12A is a plan view showing an antenna according to a fourth embodiment of the present invention.
Figure 12B:
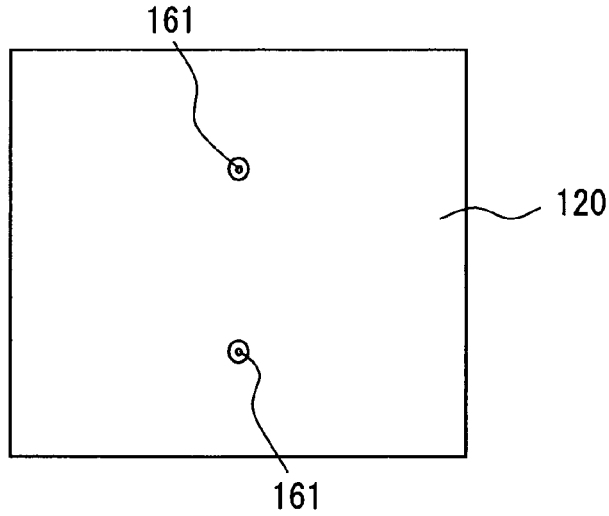
FIG. 12B is a plan view showing a surface on which a second conductive layer is formed.
Figure 12C:
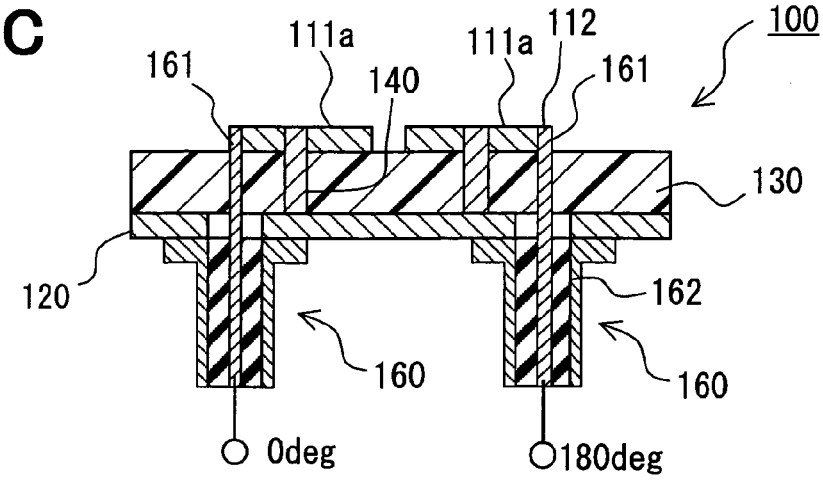
FIG. 12C is a sectional view taken along a line 12C-12C in FIG. 12A.

The antenna 100 in a fourth embodiment has many common portions with that of the first and second embodiments. In this embodiment, however, to connect to the outside, coaxial connectors 160 are disposed on the back surface (the surface on which the second conductive layer 120 is formed) of the dielectric substrate 130, so that power is fed to the antenna 100 via the coaxial connectors 160. Specifically, in the antenna 100 in the first or second embodiment, through holes are provided in positions corresponding to the power feeding sections 112 on the dielectric substrate 130, core wires 161 of the coaxial connectors 160 are penetrated from the back surface of the dielectric substrate 130 to its surface through the through holes for electrical connection (e.g., solder bonding) with the power feeding sections 112 of the elements 111*a*. The connection points correspond to the power feeding sections 112. To prevent a feeding signal from contacting the second conductive layer 120, as shown in FIG. 12B, the second conductive layer 120 is not provided in locations in which the core wires 161 are disposed, and their surrounding areas. GND 162 of the coaxial connectors 160 contacts the second conductive layer 120.

Coaxial cables are connected to the coaxial connectors 160, and power is fed so that phases of radio frequency signals are opposite to each other, that is, when the phase of one radio frequency signal is 0 degree, the phase of the other is 180 degrees.

Fifth Embodiment

Figure 11:
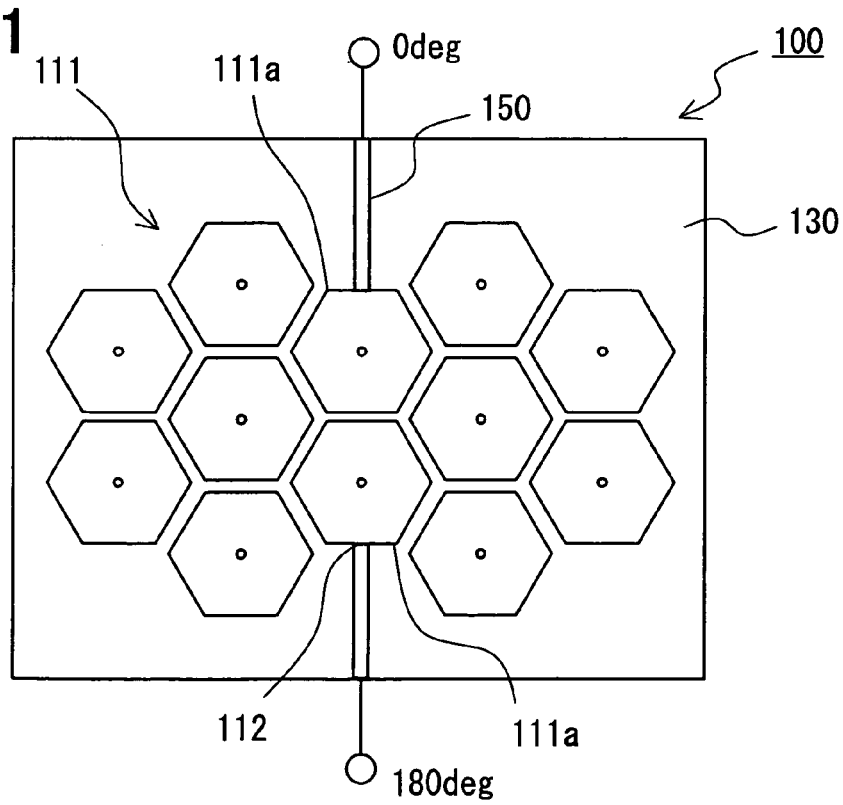
FIG. 11 is a plan view showing an antenna according to a third embodiment.
Figure 13:
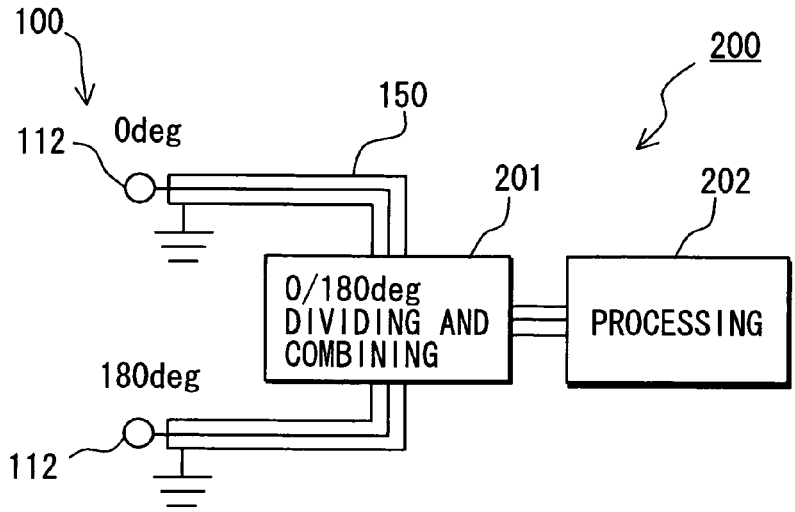
FIG. 13 is a block diagram showing radio device according to a fifth embodiment of the present invention.

General radio transmitting/receiving circuits (processing circuits) often assume that an antenna connecting terminal is connected to the antenna through a coaxial cable or microstrip line. Accordingly, radio device 200 according to this embodiment separates an antenna terminal to two signals having phases opposite to each other through a power dividing/combining circuit 201. The separated signals are propagated again through the coaxial cable and the microstrip line 150, and connected to the antenna 100 of the third (fourth) embodiment. In place of the power dividing/combining circuit 201, a balun generally used to feed power to a dipole antenna or the like from a coaxial cable may be used. In FIG. 13, the antenna 100 (FIG. 11) shown in the third embodiment is applied.

The radio device 200 according to this embodiment includes the antenna 100, the power dividing/combining circuit 201, and a processing circuit 202 that performs at least one of transmission processing and reception processing for radio frequency signals. The power dividing/combining circuit 201 operates with divided output signals or two combining input signals opposite in phase to each other. Accordingly, a feeding method that applies signals having phases opposite to each other, required in the antenna 100, is achieved by the power dividing/combining circuit 201, and small-sized radio device 200 (e.g., transceiver) including the antenna 100 having a wide frequency band can be provided. The processing circuit 202 can have a known circuit construction, and for example, includes a filter, a local transmitter, a frequency conversion part, an amplifier, a detection circuit, and the like.

Sixth Embodiment

Figure 14A:
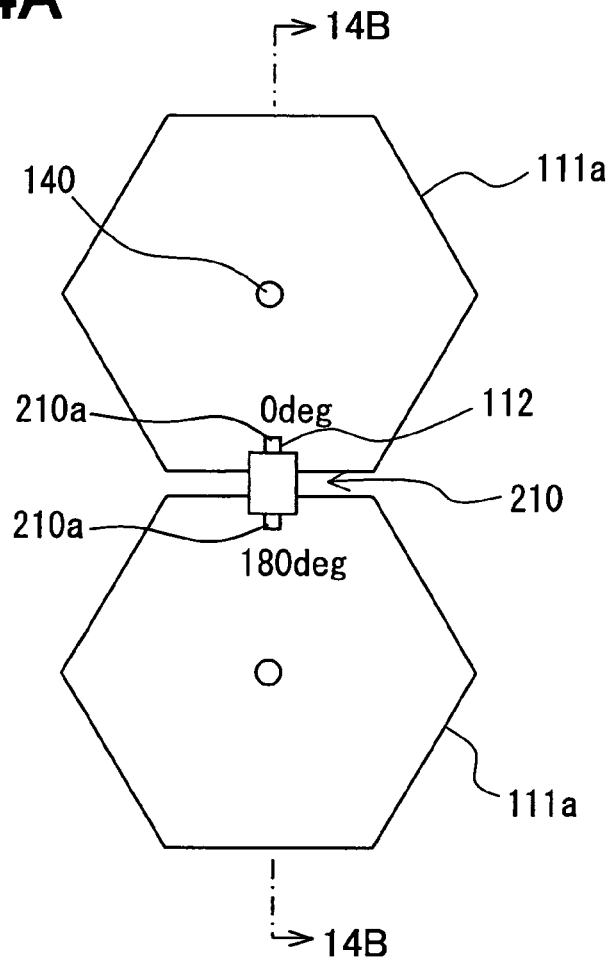
FIGS. 14A and 14B are plan views showing a periphery of IC of radio device according to a sixth embodiment of the present invention.
Figure 14B:
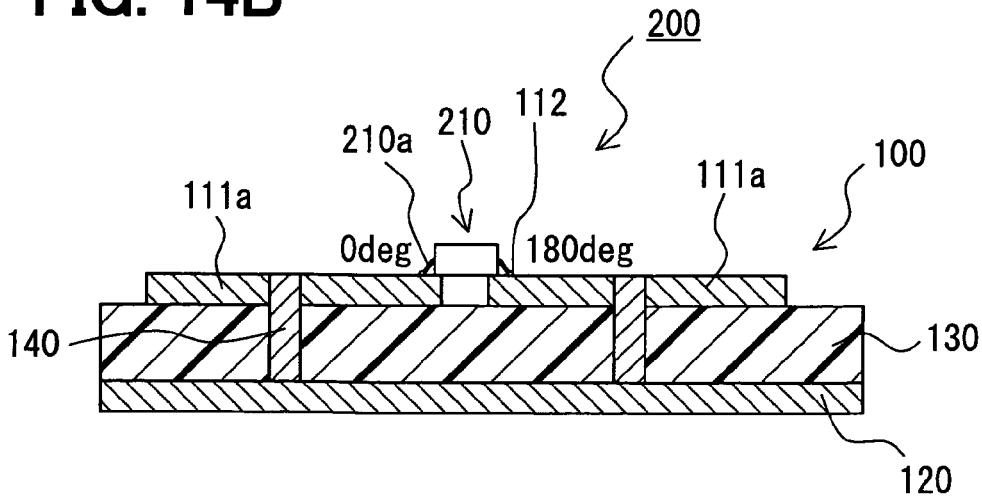

In the radio device 200 according to this embodiment, as shown in FIG. 14A and 14B, a circuit part that performs at least one of transmission processing and reception processing for radio frequency signals is housed in an integrated circuit (IC) 210 or a small-sized package, and it is mounted on the surface of the antenna 100.

Specifically, the IC 210, which is an IC for ID (IC for tag) of RFID (Radio Frequency Identification), has two feeding terminals 210*a* that can input and output signals opposite in phase to each other. The antenna 100 may have a construction relating to the first and second embodiments. In this embodiment, in the antenna 100 of the construction shown in FIG. 1, the power feeding sections 112 are provided in the centers of opposing sides of the two elements 111*a*. The IC 210 is disposed on the surface of two elements 111 that bridge the gap G, to respectively connect (e.g., solder bonding) the terminals 210*a* to the power feeding sections 112. However, in this construction, when the IC 210 is disposed over a wide range, an electric field generated by the operation of the IC 210 may influence the antenna 100 (or influence on the IC 210 by the antenna 100). Accordingly, a particularly high effect is obtained when the IC 210 of the radio device 200 is almost equal to the gap G in length, in which case small-sized radio device 200 integrated with the antenna 100, for example, an RFID tag can be produced.

Figure 15:
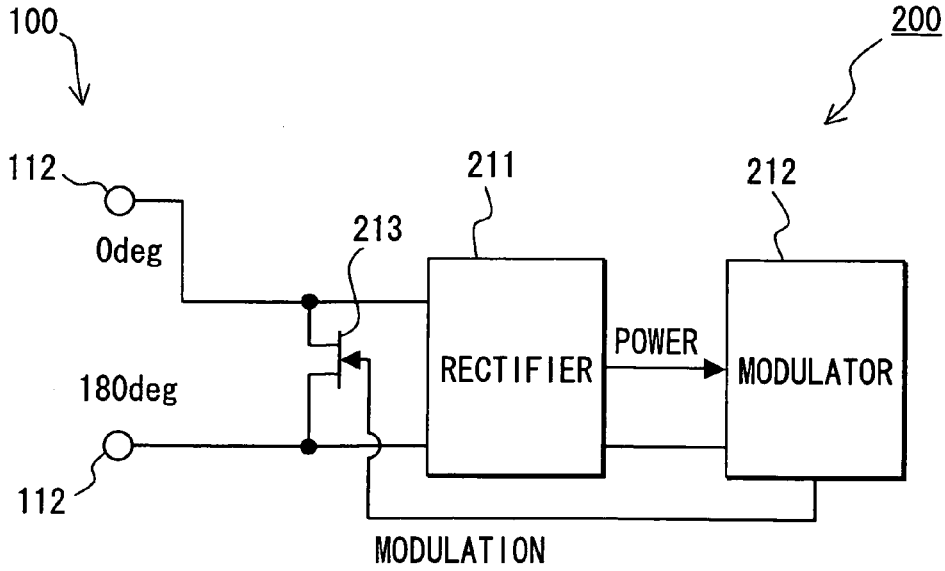
FIG. 15 is a block diagram of an RFID circuit as an example of the circuit construction of the radio device.

The circuit shown in FIG. 15, which is a circuit of a general RFID tag being known technology, rectifies a radio frequency signal received in the antenna 100 by a rectifying circuit 212, uses it as power for driving the entire RFID tag, supplies the power supply to a modulating circuit 212, controls a transistor 213 based on a response signal, and sends out the response signal from the antenna 100. These components constitute the IC 210. Many RFID circuits assume that a pair of output terminals are directly connected to a dipole antenna for use. Therefore, the respective terminals can be used unchangeably for the antennas relating to the first and second embodiments, which feed power by signals opposite in phase to each other such as 0 degree 180 degrees.

Figure 16A:
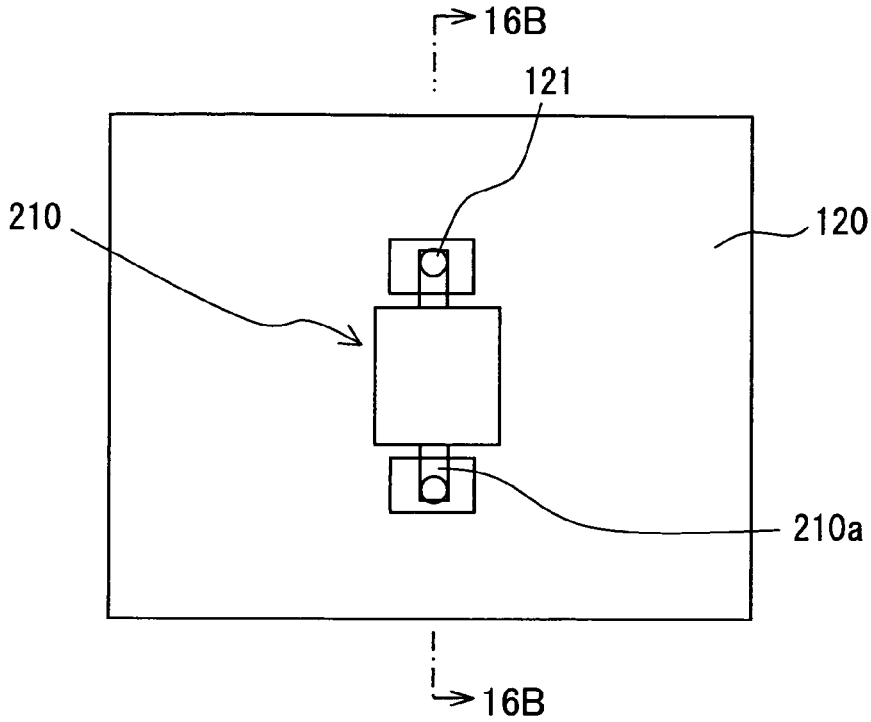
FIG. 16A is a plan view of a modification of the radio device.
Figure 16B:
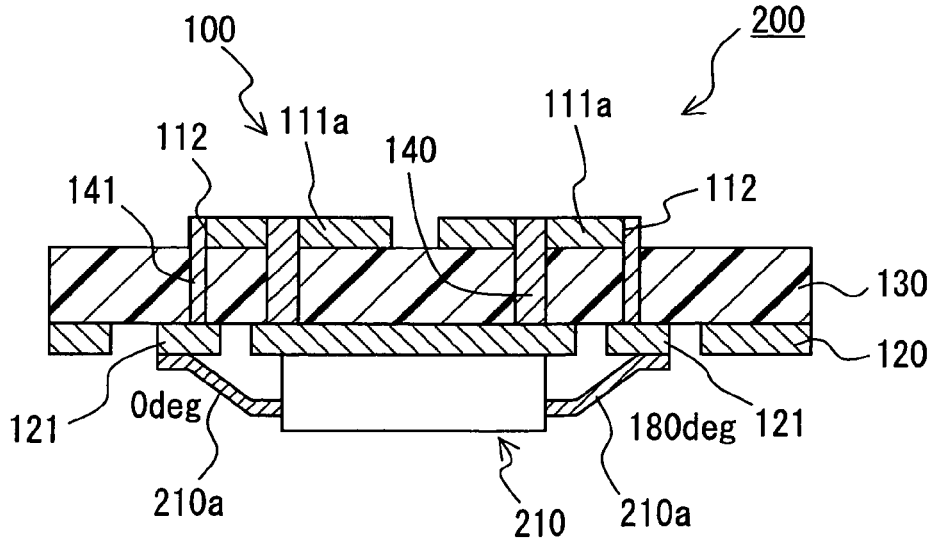
FIG. 16B is a sectional view taken along a line 16B-16B in FIG. 16A.

In this embodiment, an example of mounting the IC 210 on the surface of the elements 111 is shown. However, as shown in FIGS. 16A and 16B, the IC 210 may be mounted on the same surface (that is, the back surface) as the second conductive layer 120 of the dielectric substrate 130 to electrically connect terminals 210*a* respectively to the power feeding sections 112 via connection members for feeding 141 within via holes provided on the dielectric substrate 130. As shown in FIG. 16B, on the back surface of the dielectric substrate 130, connection locations 121 electrically connected with the connection members 141 for feeding are provided, and the terminals 210*a* of the IC 210 are connected to the connection locations 121. An electrical insulation area is provided between the connection locations 121 and the second conductive layer 120 to restrict the terminals 210*a* and the second conductive layer 120 from contacting each other when the terminals 210*a* of the IC 210 are connected to the connection locations 121. In this construction, the IC 210 is mounted on the back surface of the dielectric substrate 130. Therefore, although this construction is more complicated in structure than the construction shown in FIG. 14, influence on the antenna 100 (or influence on the IC 210 by the antenna 100) during the operation of the IC 210 can be reduced. Accordingly, an electronic part that houses in a package the IC 210 and a radio communication circuit that are a little larger than the construction shown in FIG. 14, and the antenna 100 can be integrated.

The present invention is not limited to such specific embodiments and may be modified and changed in various ways.

Figure 17:
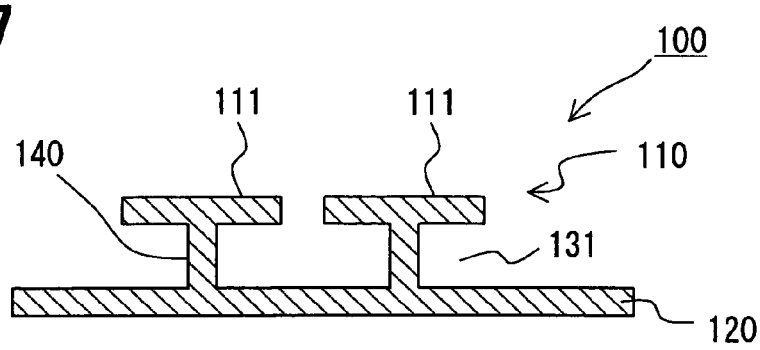
FIG. 17 is a sectional view showing another modification.
Figure 18A:
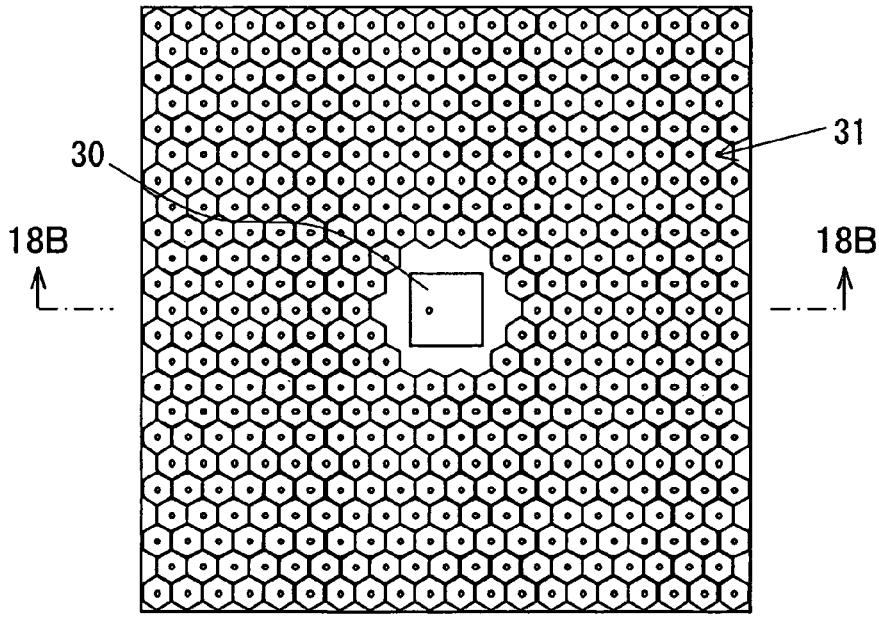
FIG. 18A PRIOR ART
FIG. 18A is a plan view of a conventional antenna.
Figure 18B:
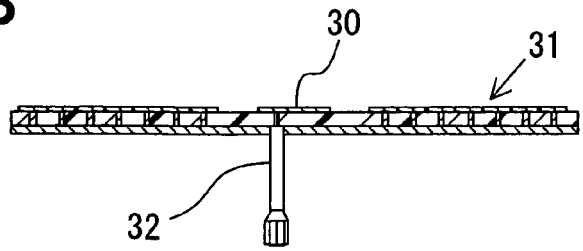
FIG. 18B PRIOR ART
FIG. 18B is a sectional view taken along a line 18B-18B in FIG. 18A.

In the above embodiments, the dielectric substrate 130 is adopted as a dielectric. However, a substrate is not absolutely essential when a dielectric is disposed between the first conductive layer 110 (each element 111) and the second conductive layer 120. Even when there is no substrate for supporting the first conductive layer 110 and the second conductive layer 120, when the first conductive layer 110 (each element 111) and the second conductive layer 120 can maintain (e.g., integral molding by press work or the like) an intended structure via connectors 140, a gas 131 (e.g., air) may be adopted as shown in FIG. 17.

In the embodiments, a regular hexagon and a square are adopted as the shape of the elements 111. However, a triangle may be adopted. In these polygonal shapes, a circle, and a construction with waveform-shaped opposing surfaces to spare the surface area of capacitor may be adopted.

What is claimed is:

1. An antenna comprising:

a first conductive layer having plural elements disposed adjacently to and distanced from each other on a same plane;

a second conductive layer disposed at a predetermined distance from the first conductive layer via a dielectric; and an LC resonance circuit comprising connection for respectively electrically connecting the elements of the first conductive layer and the second conductive layer, wherein the LC resonance circuit is constructed to take a resonance state in which impedance is increased in an operating frequency of the antenna, wherein a power feeding section is provided in each of any two adjacent elements of the plural elements, wherein, during transmission, power is fed to the power feeding sections so that signals of the operating frequency are in an opposite phase relation to each other, and wherein, during reception, signals of the operating frequency inputted to the two elements are outputted in an opposite phase relation to each other from the power feeding sections.

2. The antenna according to claim 1, wherein the plural elements all have substantially same shape and size.

3. The antenna according to claim 2, wherein the elements are polygonal in shape, and distances between opposing sides of adjacent elements are all substantially equal.

4. The antenna according to claim 3, wherein the elements are all in a regular hexagon.

5. The antenna according to claim 3, wherein the polygon is a square.

6. The antenna according to claim 3, wherein, in the two adjacent elements, the power feeding sections are respectively provided in central locations of sides opposite to each other or opposing vertex locations.

7. The antenna according to claim 3, wherein the power feeding sections are provided in locations in which a line passing through central points of the two adjacent elements intersects with edges of the elements in a plane direction, and which are in a positional relationship opposite to each other across a gap between the two adjacent elements.

8. The antenna according to claim 1, wherein the number of the plural elements is eight or more.

9. The antenna according to claim 1, wherein, in one axis direction constituting a plane, other elements are symmetrically disposed with respect to the two adjacent elements.

10. The antenna according to claim 1, wherein, in one axis direction constituting a plane, other elements are asymmetrically disposed with respect to the two adjacent elements.

11. The antenna according to claim 1, wherein other elements are disposed so as to surround a periphery of the two adjacent elements.

12. The antenna according to claim 1, wherein the dielectric is a dielectric substrate, and a microstrip line is provided on the same surface as the first conductive layer, and wherein the power feeding sections are respectively connected to the outside of the antenna via the microstrip line.

13. The antenna according to claim 1, wherein the dielectric is a dielectric substrate, and two coaxial connectors are disposed on a same surface as the second conductive layer, and wherein core wires of the coaxial connectors are respectively connected to the power feeding sections via through holes provided in the dielectric substrate.

14. A radio device comprising:

the antenna according to claim 1;

a power dividing/combining circuit; and a processing circuit that performs at least one of transmission processing and reception processing for radio frequency signals, wherein the power dividing/combining circuit operates with two divided output signals or two combining input signals opposite in phase to each other.

15. A radio device comprising:

the antenna according to claim 1; and a circuit part that performs at least one of transmission processing and reception processing for radio frequency signals, wherein the circuit part is housed in IC or a small-sized package, and is connected to the power feeding section via a terminal for external connection.

16. The radio device according to claim 15, wherein the dielectric is a dielectric substrate, and wherein the terminal of the circuit part is mounted on the same surface as the second conductive layer of the dielectric substrate, and is connected to the power feeding section of the antenna via a connecting member within a via hole provided on the dielectric substrate.

17. The radio device according to claim 15, wherein the circuit part has a function of RFID tag.

18. A method of designing the antenna according to claim 1, the method comprising:

computing a reflection phase of a signal on an antenna surface under a condition that the power feeding sections of the antenna are in an open state;

determining an operating frequency of the antenna when the calculated reflection phase is in a range from −90 degrees to +90 degrees; and changing antenna specifications until the determined operating frequency becomes an intended frequency.

19. A method of measuring an operating frequency of the antenna according to claim 1, the method comprising:

driving the power feeding sections of the antenna into an open state;

measuring a reflection phase of a signal on an antenna surface; and determining an operating frequency of the antenna when the measured reflection phase is in a range from −90 degrees to +90 degrees.

* * * * *